US010232385B2

(12) United States Patent
Cheng

(10) Patent No.: US 10,232,385 B2
(45) Date of Patent: Mar. 19, 2019

(54) SINGLE OR DUAL SIDED DIRECTION-CONTROLLABLE SPRINKLER

(71) Applicant: Yuan Mei Corp., Chang Hua Hsien (TW)

(72) Inventor: Chi-Han Cheng, Chang Hua Hsien (TW)

(73) Assignee: Yuan Mei Corp., Chang Hua Hsien (TW)

( * ) Notice: Subject to any disclaimer, the term of this patent is extended or adjusted under 35 U.S.C. 154(b) by 33 days.

(21) Appl. No.: 15/606,271

(22) Filed: May 26, 2017

(65) Prior Publication Data

US 2018/0339302 A1 Nov. 29, 2018

(51) Int. Cl.

| | |
|---|---|
| ***B05B 1/00*** | (2006.01) |
| ***B05B 1/30*** | (2006.01) |
| ***B05B 3/04*** | (2006.01) |
| ***B05B 15/652*** | (2018.01) |

(52) U.S. Cl.

CPC ..... *B05B 1/30* (2013.01); *B05B 3/044* (2013.01); *B05B 15/652* (2018.02)

(58) Field of Classification Search

CPC ..... B05B 15/08; B05B 15/066; B05B 15/04; B05B 1/14

USPC ..... 239/225.1, 227, 240, 246, 247, DIG. 1, 239/DIG. 12, 242

See application file for complete search history.

(56) References Cited

U.S. PATENT DOCUMENTS

| | | | | | |
|---|---|---|---|---|---|
| 2,943,796 | A | * | 7/1960 | Smith | B05B 3/044 239/237 |
| 3,212,719 | A | * | 10/1965 | Di Corpo | A62C 2/08 239/541 |
| D221,336 | S | * | 8/1971 | Raffler et al. | D23/216 |
| 3,647,140 | A | * | 3/1972 | Perrot | B05B 3/044 239/242 |
| 3,767,118 | A | * | 10/1973 | Oberto | B05B 3/044 137/834 |
| 3,907,204 | A | * | 9/1975 | Przystawik | B05B 3/16 239/19 |
| 4,245,786 | A | * | 1/1981 | Abrahamsen | B05B 3/044 239/242 |
| D282,769 | S | * | 2/1986 | Lemkin | D23/216 |
| 4,632,313 | A | * | 12/1986 | Rinkewich | B05B 1/1654 137/624.14 |
| 4,721,248 | A | | 1/1988 | Chow | |

(Continued)

FOREIGN PATENT DOCUMENTS

| | | |
|---|---|---|
| CN | 101085431 C | 12/2007 |
| CN | 102574146 B | 7/2012 |

(Continued)

*Primary Examiner* — Viet Le

(74) *Attorney, Agent, or Firm* — Stinson Leonard Street

(57) ABSTRACT

A single or dual sided direction-controllable sprinkler comprises two rotatable trigger portions slidably disposed on a main body. When one trigger portion is limited by a fastener, the two trigger portions have the same rotational position, and when the one trigger portion is not limited by the fastener, the rotational positions of the two trigger portions are controlled independently. The fastener is selectively connected to allow the user to selectively control one of the trigger portions or both of the trigger portions together so that various water sprinkling modes are available.

7 Claims, 6 Drawing Sheets

(56) References Cited

U.S. PATENT DOCUMENTS 5,042,719 A * 8/1991 Magris ..... B05B 3/044 239/242
5,305,956 A * 4/1994 Wang ..... B05B 1/1645 239/242
5,511,727 A * 4/1996 Heren ..... B05B 3/044 239/242
5,628,458 A * 5/1997 Kuo ..... B05B 1/20 239/242
5,730,366 A * 3/1998 DeWitt ..... B05B 1/20 239/242
5,845,850 A * 12/1998 Guo ..... B05B 3/044 239/242
6,062,490 A * 5/2000 Katzer ..... B05B 1/30 239/246
6,135,356 A * 10/2000 Mitzlaff ..... B05B 15/652 239/1
6,334,577 B1 * 1/2002 Chih ..... A62C 31/02 239/242
6,520,430 B2 2/2003 Chao
6,568,603 B2 * 5/2003 Chao ..... B05B 1/1627 239/242
6,676,041 B1 * 1/2004 McLoughlin ..... B05B 1/20 239/450
6,736,340 B1 * 5/2004 Wang ..... A62C 2/08 239/242
7,252,246 B2 * 8/2007 Heren ..... B05B 1/1654 239/242
7,258,286 B1 * 8/2007 Wang ..... A62C 2/08 239/240
7,284,714 B1 * 10/2007 Wang ..... B05B 1/1663 239/240
7,607,590 B2 * 10/2009 Nies ..... B05B 15/652 239/255
D620,552 S * 7/2010 Mayher ..... D23/221
7,909,266 B2 * 3/2011 Lo ..... B05B 3/044 239/240
8,468,787 B2 6/2013 Nies et al.
8,998,108 B2 * 4/2015 Hsieh ..... B05B 15/063 239/242
2007/0235568 A1 * 10/2007 Wang ..... B05B 1/1663 239/562
2008/0054103 A1 * 3/2008 Nies ..... B05B 15/652 239/562
2009/0308950 A1 * 12/2009 Lo ..... B05B 3/044 239/242
2016/0354792 A1 * 12/2016 Su ..... B05B 3/14

FOREIGN PATENT DOCUMENTS

CN 105475093 A 4/2016
EP 0394653 A1 10/1990
TW M314643 U 7/2007
TW 200731921 A 9/2007
TW M467294 U 12/2013
TW M480849 U 7/2014
TW M494479 U 2/2015
TW M504446 U 7/2015
TW M528547 U 9/2016

* cited by examiner

SINGLE OR DUAL SIDED DIRECTION-CONTROLLABLE SPRINKLER

TECHNICAL FIELD

The present disclosure relates to a sprinkler and more particularly to a single or dual sided direction-controllable sprinkler.

BACKGROUND

Conventional sprinklers employ a single trigger switch to control the directions of sprinkling of a sprinkler, such as disclosed in U.S. Pat. No. 7,607,590. In U.S. Pat. No. 7,909,266, two trigger switches are employed to control the directions of sprinkling of sprinklers on two sides. The upward or outward sprinkling direction of the sprinkler is controlled by the triggering of the trigger switches.

However, the trigger switch of conventional sprinklers only allows triggering in a single way. The single trigger switch can only control to sprinkle outwardly or upwardly. As for the two trigger switches, it needs to trigger two times to achieve the same effect if the sprinkling directions on the two sides are the same. It is inconvenient to use.

SUMMARY

A single or dual sided direction-controllable sprinkler embodying aspects of the present invention comprises a main body with an accommodation chamber disposed inside, a water inlet being disposed on a side of the accommodation chamber, and a plurality of water outlets being disposed on a top of the accommodation chamber; two rotatable trigger portions slidably disposed on the main body, a plurality of slant guiding openings corresponding to the water outlets being disposed on the trigger portions, the water outlets going through the guiding openings, the slant angles of the water outlets being changed by positions of the guiding openings, and a trigger protrusion being protruded from each of two sides of each of the trigger portions; at least one fastener disposed on one of the trigger portions and selectively fixed with the other trigger portion, when the other trigger portion being limited by the fastener, the two trigger portions having the same rotational position, and when the other trigger portion being not limited by the fastener, the rotational positions of the two trigger portions being controlled independently; and a cover disposed with a plurality of direction guiding holes, and the water outlets going through the direction guiding holes.

When the fastener of the single or dual sided direction-controllable sprinkler of the present invention is not connected with the trigger portions, the positions of the two trigger portions are adjusted separately to control the sprinkling directions. When the fastener is fixedly connected with the trigger portions, the positions of the two trigger portions are adjusted simultaneously to achieve synchronous effect. Therefore, various water sprinkling modes are available the user.

An oscillating sprinkler embodying aspects of the invention comprises an elongate main body that has a hollow tube disposed therein and configured for connection to a water source. The sprinkler also includes a plurality of nozzles in fluid communication with the tube. The nozzles are each positioned at an adjustable angle relative to the main body. A pair of guides are disposed on the main body and have a plurality of angled guide openings through which the nozzles extend for adjusting the angles of the nozzles. The guides are independently rotatable relative to the main body and each has a trigger extending from it. The trigger of one of the guides is configured for selectively engaging the trigger of the other of the guides in a mating relationship. The sprinkler has a fastener configured for selectively securing the triggers in the mating relationship such that the guides have the same rotatable position when the triggers are secured in the mating relationship by the fastener and are independently controllable when the triggers are not secured in the mating relationship by the fastener.

The present invention will become more fully understood by reference to the following detailed description thereof when read in conjunction with the attached drawings.

BRIEF DESCRIPTION OF THE DRAWINGS

Corresponding reference characters indicate corresponding parts throughout the drawings.

DETAILED DESCRIPTION

Figure 1:
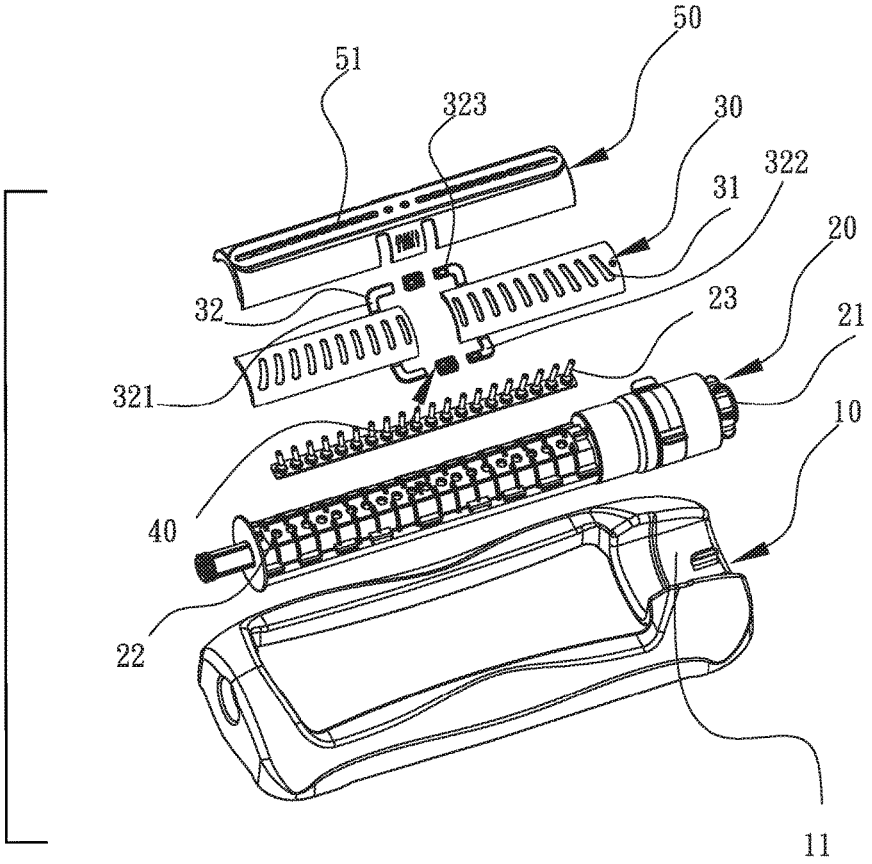
FIG. 1 is an exploded perspective view of a preferred embodiment of a single or dual sided direction-controllable sprinkler of the present invention.

Please refer to FIG. 1. FIG. 1 is an exploded perspective view of a preferred embodiment of a single or dual sided direction-controllable sprinkler of the present invention. The single or dual sided direction-controllable sprinkler mainly comprises a base 10, a main body 20, two trigger portions 30, two fasteners 40 and a cover 50.

The base 10 is disposed with a combination seat 11.

The main body 20 is pivotally disposed on the combination seat 11. An accommodation chamber 21 is disposed inside the main body 20. A water inlet 22 is disposed on a side of the accommodation chamber 21, and a plurality of water outlets 23 is disposed on a top of the accommodation chamber 21. In an embodiment, the accommodation chamber 21 is a hollow tube configured for connection to a water source and the water outlets 23 are a plurality of nozzles in fluid communication with the tube.

The two rotational trigger portions 30 are slidably disposed on the main body 10. A plurality of slant guiding openings 31 corresponding to the water outlets 23 is disposed on the trigger portions 30. The water outlets 23 go through the guiding openings 31. The slant angles of the water outlets 23 are changed by positions of the guiding openings 31. A trigger protrusion 32 is protruded from each of two sides of each of the trigger portions 30. The trigger protrusion 32 comprises an arm 321 and a connecting section 322. The arm 321 is roughly perpendicular to the main body 10. The connecting section 322 is extended from a free end of the arm 321 towards the other arm 321 so that the two connecting sections 322 are disposed close to each other. When the trigger portions 30 are positioned in a same way, positions of the two connecting sections 322 are also in a same way. The connecting section 322 of one of the two trigger portions 30 has a slide rail 323. In an embodiment, the trigger portions 30 comprise a pair of guides disposed on the main body and having a plurality of angled guide openings through which the nozzles extend for adjusting the angles of the nozzles. In this embodiment, the guides are independently rotatable relative to the main body and each of the guides has a trigger extending from it. The trigger of one of the guides is configured for selectively engaging the trigger of the other of the guides in a mating relationship.

Figure 2:
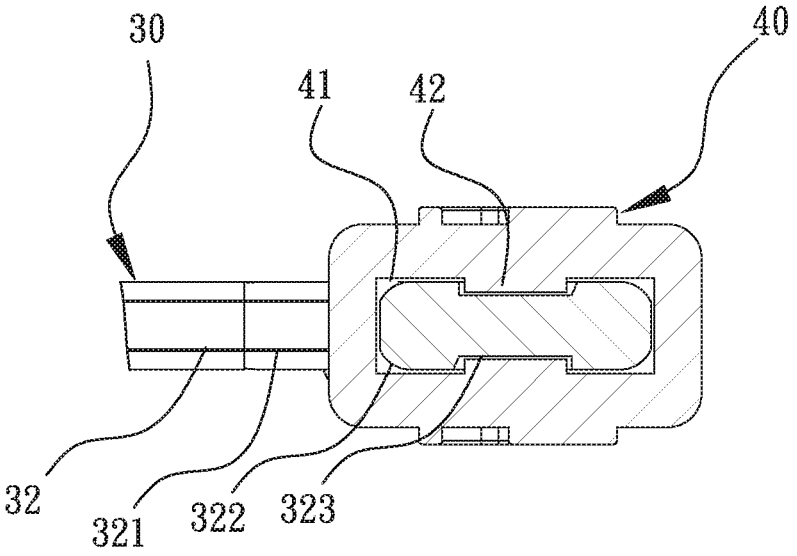
FIG. 2 is a sectional view of a fastener and a trigger protrusion of the preferred embodiment of the single or dual sided direction-controllable sprinkler of the present invention.
Figure 3A:
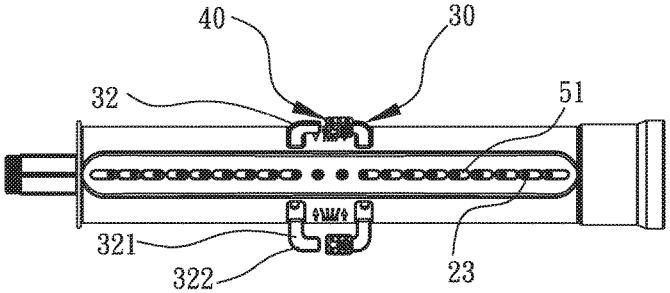
FIGS. 3A to 3D are operational views of a non-connected trigger portion of the preferred embodiment of the single or dual sided direction-controllable sprinkler of the present invention.
Figure 3B:
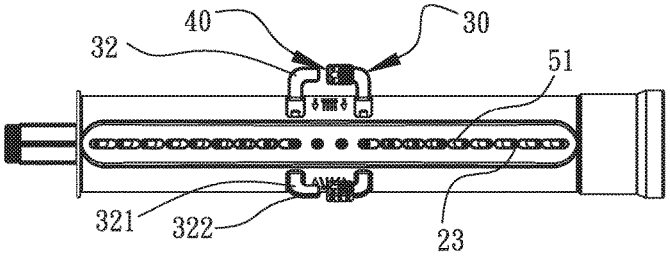
Figure 3C:
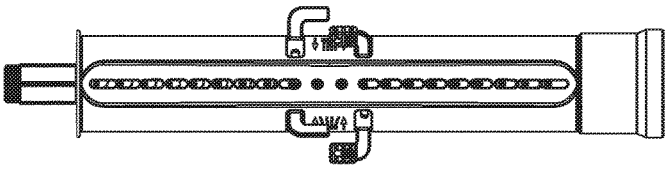
Figure 3D:
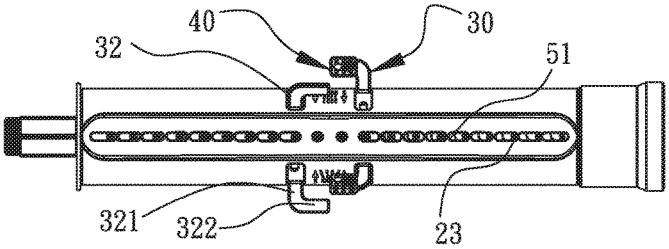
Figure 4A:
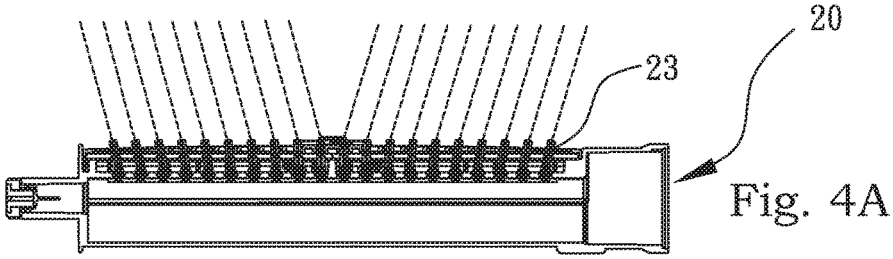
FIGS. 4A to 4D are sprinkling views of the non-connected trigger portion of the preferred embodiment of the single or dual sided direction-controllable sprinkler of the present invention.
Figure 4B:
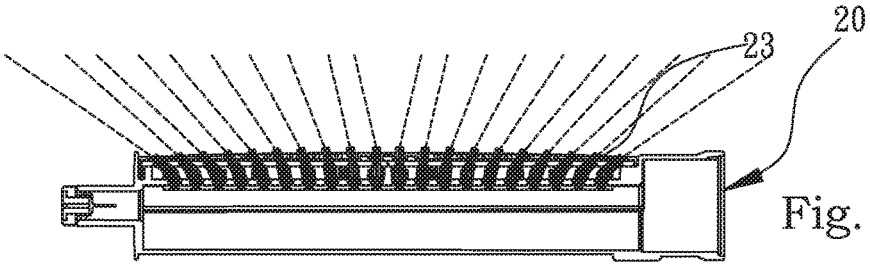
Figure 4C:
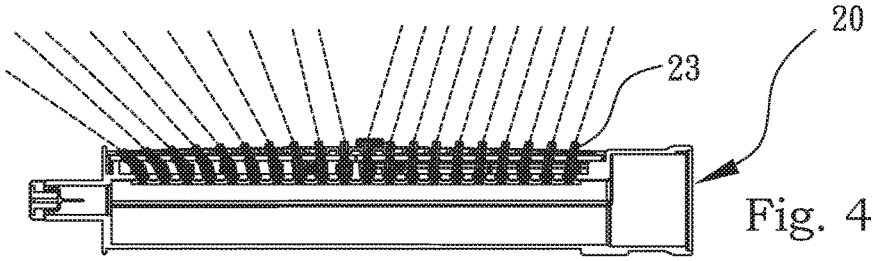
Figure 4D:
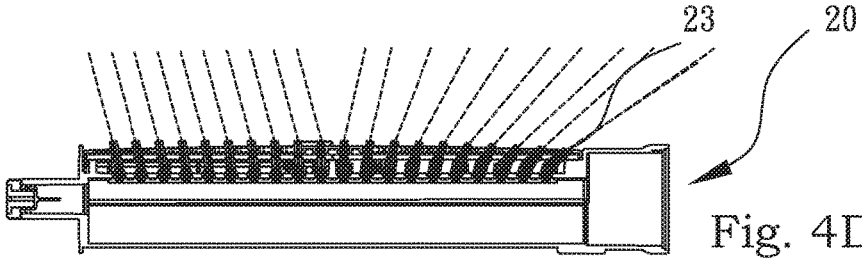
Figure 5A:
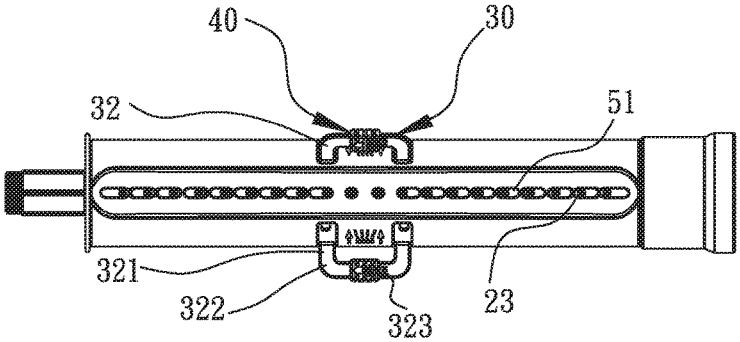
FIGS. 5A and 5B are operational views of the connected trigger portion of the preferred embodiment of the single or dual sided direction-controllable sprinkler of the present invention.
Figure 5B:
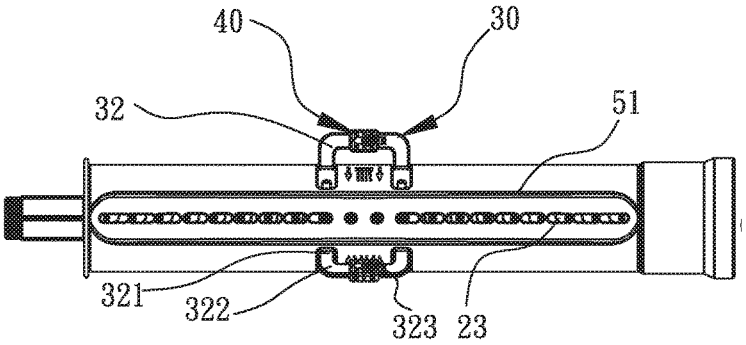
Figure 6A:
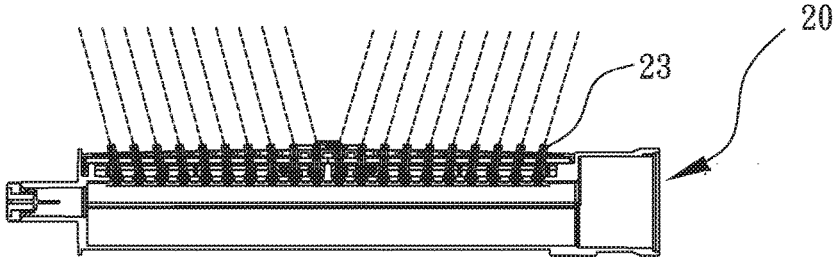
FIGS. 6A and 6B are sprinkling views of the connected trigger portion of the preferred embodiment of the single or dual sided direction-controllable sprinkler of the present invention.
Figure 6B:
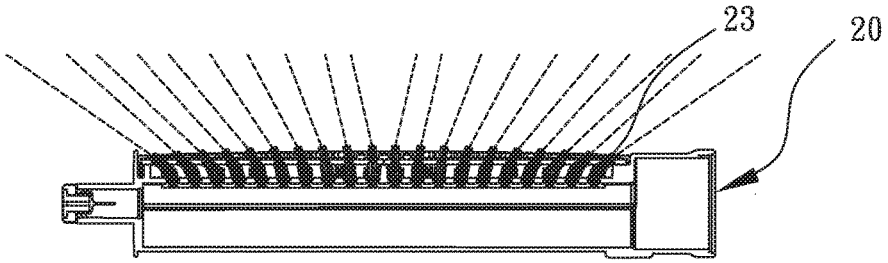

Please refer to FIG. 2. FIG. 2 is a sectional view of the fastener and the trigger protrusion of the preferred embodiment of the single or dual sided direction-controllable sprinkler of the present invention. The fastener 40 has a groove 41, and a limitation piece 42 is protrudingly disposed inside the groove 41. The limitation piece 42 is slidably and limitedly disposed on the slide rail 323 of the connecting section 322 in order to allow the fastener 40 to slide on the connecting section 322. The fasteners 40 are selectively fixed with the other trigger protrusion 32 so that the two trigger protrusions 32 are coupled or separated. An area of the groove 41 is close to that of the connecting section 322. The other connecting section 322 can also be securely and limitedly connected with the groove 41. In an embodiment, the fastener 40 is configured for selectively securing the triggers in the mating relationship such that the guides have the same rotatable position when the triggers are secured in the mating relationship by the fastener and are independently controllable when the triggers are not secured in the mating relationship by the fastener.

The cover 50 is disposed with a plurality of direction guiding holes 51. The water outlets 23 go through the direction guiding holes 51. The positions of the water outlets 23 are changed along the longitudinal shape of the direction guiding holes 51.

In order to further explain the structures and characteristics of the present invention, as well as the technical means and expected effects; the ways of usage are specifically described hereunder for in-depth understanding.

Please refer to FIGS. 3A to 3D and 4A to 4D. When the fasteners 40 are not connected with the two closely disposed connecting sections 322, the two trigger portions 30 are operated separately for adjusting sprinkling positions. The trigger portions 30 are facing outward or upward at the same time; or one of the trigger portions 30 is facing upward, while the other trigger portion 30 is facing outward. Each of the trigger portions 30 is adjusted individually. Therefore, four different sprinkling combinations are available to meet different requirements and needs.

When the two trigger portions 30 are needed to connect together, set the two trigger portions 30 at a same sprinkling position, and move the fasteners 40 along the slide rail 323 so that the other connecting section 322 is guided inside the groove 41. The two closely disposed connecting sections 322 are limited and fixed by the fastener 40. Because the area of the groove 41 is close to that of the connecting section 322, the fastener 40 is securely disposed on the connecting section 322 and does not detach from each other after the fastener 40 is connected with the other connecting section 322. After the connecting section 322 is limited by the fastener 40, the two trigger portions 30 have the same sprinkling position. Please refer to FIGS. 5A, 5B, 6A and 6B. The trigger portions 30 are facing upward or outward at the same time. When the same sprinkling direction of the two trigger portions 30 is required, simply adjust one of the two trigger protrusions 32 in order to have two of the trigger portions 30 adjusted simultaneously. There is no need to adjust the sprinkling position separately. Therefore, steps required for adjusting are reduced and the inaccuracy of sprinkling position between the two trigger portions 30 is also reduced.

Note that the specifications relating to the above embodiments should be construed as exemplary rather than as limitative of the present invention, with many variations and modifications being readily attainable by a person of average skill in the art without departing from the spirit or scope thereof as defined by the appended claims and their legal equivalents.

When introducing elements of the present invention or the preferred embodiments thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A sprinkler for single or dual sided direction control, at least comprising:

a main body with an accommodation chamber disposed inside, a water inlet being disposed on a side of the accommodation chamber, and a plurality of water outlets being disposed on a top of the accommodation chamber;

two rotatable trigger portions slidably disposed on the main body, a plurality of slant guiding openings corresponding to the water outlets being disposed on the trigger portions, the water outlets going through the guiding openings, the slant angles of the water outlets being changed by positions of the guiding openings, at least one trigger protrusion being disposed on the trigger portions, the trigger protrusions comprising a connecting section, the two connecting sections being extended toward the connecting section of the other trigger portion so that the two connecting sections being disposed close to each other, when the trigger portions being positioned in a same way, positions of the two connecting sections being also in a same way, and one of the connecting sections having a slide rail;

at least one fastener penetrated with a groove for allowing the fastener to dispose on the connecting section, the fastener being selectively fixed with the connecting section of the other trigger protrusion, when the other trigger protrusion being limited by the fastener, the two trigger portions having the same rotational position, and when the other trigger protrusion being not limited by the fastener, the rotational positions of the two trigger portions being controlled independently; and a cover disposed with a plurality of direction guiding holes, and the water outlets going through the direction guiding holes.

2. The sprinkler for single or dual sided direction control as claimed in claim 1, wherein at least one limitation piece is protrudingly disposed inside the groove, and the limitation piece is limitedly disposed on the slide rail of the connecting section.

3. A sprinkler for single or dual sided direction control, at least comprising:

a main body with an accommodation chamber disposed inside, a water inlet being disposed on a side of the accommodation chamber, and a plurality of water outlets being disposed on a top of the accommodation chamber;

two rotatable trigger portions slidably disposed on the main body, a plurality of slant guiding openings corresponding to the water outlets being disposed on the trigger portions, the water outlets going through the guiding openings, the slant angles of the water outlets being changed by positions of the guiding openings, a trigger protrusion being disposed on the trigger portions;

at least one fastener disposed on one of the trigger portions, the fastener being selectively fixed with the other trigger portion, when the other trigger portion being limited by the fastener, the two trigger portions having the same rotational position, and when the other trigger portion being not limited by the fastener, the rotational positions of the two trigger portions being controlled independently; and a cover disposed with a plurality of direction guiding holes, and the water outlets going through the direction guiding holes.

4. The sprinkler for single or dual sided direction control as claimed in claim 3, wherein the trigger protrusions comprise a connecting section, the connecting section is extended towards the connecting section of the other trigger portion so that the two connecting sections are disposed close to each other, and when the trigger portions are positioned in a same way, positions of the two connecting sections are also in a same way so that the fasteners are connected with the connecting sections.

5. The sprinkler for single or dual sided direction control as claimed in claim 4, wherein the fastener is penetrated with a groove disposed around the connecting section, at least one limitation piece is protrudingly disposed inside the groove, the limitation piece is limitedly disposed on a slide rail of one of the connecting sections in order to allow the fastener to slide on the connecting section, and to allow the fastener to slidably connected with the other connecting section.

6. An oscillating sprinkler comprising:

an elongate main body having a hollow tube disposed therein and configured for connection to a water source;

a plurality of nozzles in fluid communication with the tube, the nozzles each being positioned at an adjustable angle relative to the main body;

a pair of guides disposed on the main body and having a plurality of angled guide openings through which the nozzles extend for adjusting the angles of the nozzles, the guides being independently rotatable relative to the main body, each of the guides having a trigger extending therefrom, the trigger of one of the guides being configured for selectively engaging the trigger of the other of the guides in a mating relationship; and a fastener configured for selectively securing the triggers in the mating relationship such that the guides have the same rotatable position when the triggers are secured in the mating relationship by the fastener and are independently controllable when the triggers are not secured in the mating relationship by the fastener.

7. The oscillating sprinkler of claim 6, wherein each of the triggers comprises a connecting section and a slide rail, and wherein the fastener has a groove configured for receiving the connecting section and a limitation piece configured for being received by the slide rail.

* * * * *